US012256832B1

(12) United States Patent
Singhal

(10) Patent No.: US 12,256,832 B1
(45) Date of Patent: Mar. 25, 2025

(54) ERGONOMIC DEVICE THAT ASSISTS USERS TO DRAW AND WRITE, PROVIDING SUPPORT FOR RESTING THE HAND AND HOLDING THE TOUCHSCREEN COMPUTER TABLET

(71) Applicant: Darpan Singhal, Wyomissing, PA (US)

(72) Inventor: Darpan Singhal, Wyomissing, PA (US)

( * ) Notice: Subject to any disclaimer, the term of this patent is extended or adjusted under 35 U.S.C. 154(b) by 0 days.

(21) Appl. No.: 18/914,072

(22) Filed: Oct. 12, 2024

Related U.S. Application Data

(60) Provisional application No. 63/596,251, filed on Nov. 4, 2023.

(51) Int. Cl.
*A47B 23/00* (2006.01)

(52) U.S. Cl.
CPC ..... *A47B 23/002* (2013.01); *A47B 23/001* (2013.01)

(58) Field of Classification Search
CPC ..... A47B 23/002; A47B 23/001
See application file for complete search history.

(56) References Cited

U.S. PATENT DOCUMENTS 8,393,812 B2 3/2013 Shultz
8,863,672 B1 * 10/2014 Silknitter ..... A63F 3/00895 108/43
9,999,298 B1 * 6/2018 Sullins ..... A47B 13/16
10,125,915 B1 * 11/2018 Phifer ..... F16M 11/041
11,938,749 B2 3/2024 Genovese
2007/0020021 A1 1/2007 Snyder
2012/0024200 A1 * 2/2012 Raney ..... A47B 23/002 108/14
2016/0019809 A1 1/2016 Schlosser
2017/0318959 A1 * 11/2017 Castleberry ..... F16M 13/04

OTHER PUBLICATIONS

Amazon.com, MoKo Case for iPad 10th Generation with Pencil Holder, Mar. 17, 2023, https://www.amazon.com/MoKo-Generation-Pencil-Protector-Viewing/dp/B0BYSJS26V/ (Year: 2023).*

* cited by examiner

*Primary Examiner* — Stephen A Vu

(57) ABSTRACT

This invention is directed to an ergonomic device designed to improve touchscreen tablet use for individuals with limited mobility or hand deformities. It features a transparent, anti-touch-sensitive plate that covers the screen, preventing accidental touch inputs while maintaining full visibility. An opening allows the hand to rest or grip the tablet naturally, facilitating a traditional writing posture. The device stabilizes the tablet and enhances control, comfort, and writing legibility. It is especially beneficial for elderly users and those with physical limitations, improving ease of use and reducing errors on touchscreen interface.

7 Claims, 9 Drawing Sheets

ERGONOMIC DEVICE THAT ASSISTS USERS TO DRAW AND WRITE, PROVIDING SUPPORT FOR RESTING THE HAND AND HOLDING THE TOUCHSCREEN COMPUTER TABLET

CROSS-REFERENCE TO RELATED APPLICATIONS

This application claims the benefit of U.S. Provisional Patent Application No. 63/596,251 filed Nov. 4, 2023 and entitled "Ergonomic Device Enables Users To Draw And Write While Allowing Hand Resting And Holding The Touchscreen Computer Tablet", the contents of which are hereby incorporate by reference.

FIELD OF THE INVENTION

The disclosed embodiments relate to an ergonomic device designed for touchscreen computer tablets, specifically ergonomic tablet accessories. This device assists users in stabilizing the tablet while allowing them to rest their hand without inadvertently activating the touch screen and able to draw or write on it.

BACKGROUND OF THE INVENTION

The approaches described in this section could be pursued, but are not necessarily approaches that have previously been conceived or pursued. Therefore, unless otherwise indicated, it should not be assumed that any of the approaches described in this section qualify as prior art merely by virtue of their inclusion in this section.

The advent of digital technology has significantly transformed the process of capturing signatures. However, this transition has not been entirely seamless, particularly for elderly individuals who often face challenges when using touchscreen tablets and other electronic devices. For this demographic, such technologies can create perceived barriers, making it difficult for them to fully participate in today's increasingly digital environment.

In the healthcare sector, obtaining signatures is a critical process, whether for consent forms, HIPAA compliance, or other medical documentation. Many of these signatures are now captured electronically, especially when patients are not in optimal physical condition.

Touchscreen computer tablets have become the preferred medium for securing these essential signatures.

However, the shift from traditional pen-and-paper methods to digital platforms poses a considerable challenge for the elderly population. Individuals in this demographic often struggle with comorbidities such as osteoarthritis, hand contractures, limited range of motion, and poor motor control. When using pen and paper, one hand naturally stabilizes the paper while the other writes, with the hand resting at two key points: the heel of the hand and the lower side of the curled little finger. This resting position provides stability and allows precise control of the writing instrument, as well as regulating the pressure applied while writing.

Replicating this natural writing posture on touchscreen tablets, however, presents significant difficulties. Current assistive technologies often rely on wearable devices, which can interfere with how users naturally grip and handle writing instruments. Since grip techniques vary greatly among individuals, it is crucial to preserve each user's natural writing method. Wearable devices typically do not allow the user to stabilize the tablet with one hand while writing with the other, and they prevent the natural resting of the hand on the tablet surface. Furthermore, existing technologies are not universally adaptable to different hand sizes, grip techniques, or specific physical limitations, and they tend to be prohibitively expensive.

This invention addresses these challenges by providing an ergonomic solution that mimics the familiar hand-resting posture used in traditional writing, while allowing users to grip the tablet for stability. By enhancing the writing experience on touchscreen devices, the invention ensures greater comfort, stability, and control, particularly for individuals with limited mobility.

SUMMARY OF THE INVENTION

An embodiment of the present invention relates to an ergonomic device for use with touchscreen computer tablets. The device comprises a transparent, anti-touch-sensitive plate configured to be positioned over the tablet screen, allowing full visibility while preventing unintentional touch activation. The device includes an opening that provides access to the touchscreen, with designated areas allowing the hand to rest or grip the tablet without triggering any touch input. The top and side portions of the opening enable secure handling of the tablet while maintaining its touch functionality. A curved portion is included to anchor and stabilize the touchscreen tablet and plate together. The material of the device is durable, easy to clean, and features smooth, rounded edges to minimize risk of injury or skin irritation. The device can be embodied in various forms and adapted to meet different usage needs.

In various embodiments, the device is configured to stabilize a tablet by providing a secure grip without triggering touch input. It is further designed to offer a resting area for the hand on the plate surface, enabling support without interfering with the touchscreen's functionality. The transparent plate allows full visibility of the tablet screen. The device facilitates a natural writing style on the touchscreen without disrupting its sensitivity, and may assist individuals with hand deformities or limited range of motion by providing a more natural writing posture. Additionally, the device improves writing control, legibility, ease of stylus use, writing pace, and reduces error rates, thereby enhancing the overall writing experience.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION OF THE INVENTION

Figure 1:
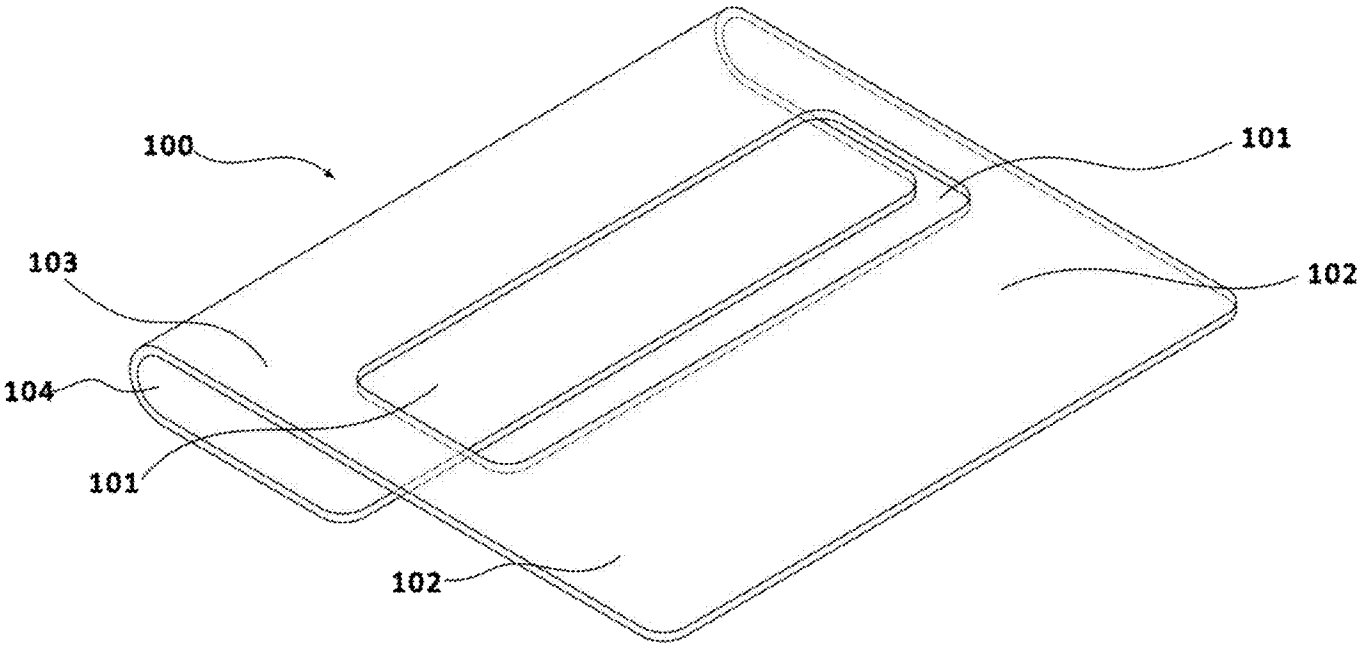
FIG. 1 is a perspective view of the ergonomic device that allows users to draw and write, providing support for resting the hand and holding the touchscreen computer tablet, according to various embodiments of the present technology.

In the following description, for purposes of explanation, numerous specific details are set forth in order to provide a thorough understanding of the disclosure. It will be apparent, however, to one skilled in the art, that the disclosure may be practiced without these specific details. In other instances, structures and devices may be shown in block diagram form only in order to avoid obscuring the disclosure. It should be understood, that the disclosed embodiments are merely exemplary of the invention, which may be embodied in multiple forms. Those details disclosed herein are not to be interpreted in any form as limiting, but as the basis for the claims.

The present invention provides an ergonomic device designed to assist individuals in using touchscreen computer tablets in a manner that mimics the natural way of writing. This ergonomic device offers stabilization, a comfortable hand rest, and improved control, making it easier to use a stylus pen. The following examples describe the invention in enabling detail, representing one or more embodiments.

Referring now to the drawings, where like reference characters denote like elements across the various views, the ergonomic device is generally indicated by the numeral 100. The figures illustrate an example embodiment comprising a transparent anti-touch sensitive plate 100 (also referenced as ergonomic device 100 hereinafter) positioned parallel to a touchscreen computer tablet 105. The plate includes an opening 101 or more openings (not shown) to access the touchscreen 106. The bottom portion 102 of the ergonomic device allows the user to rest their hand without activating the touch-sensitive surface. The top and side portions 103 of the opening 101 provide a way to hold the touchscreen computer tablet 105 securely without triggering the touchscreen 106. Additionally, the ergonomic device 100 features a curve 104 that anchors and stabilizes both the touchscreen the touchscreen computer tablet 105 and the ergonomic device 100. The ergonomic device 100 may be constructed from a material that is easy to clean and disinfect.

Figure 3:
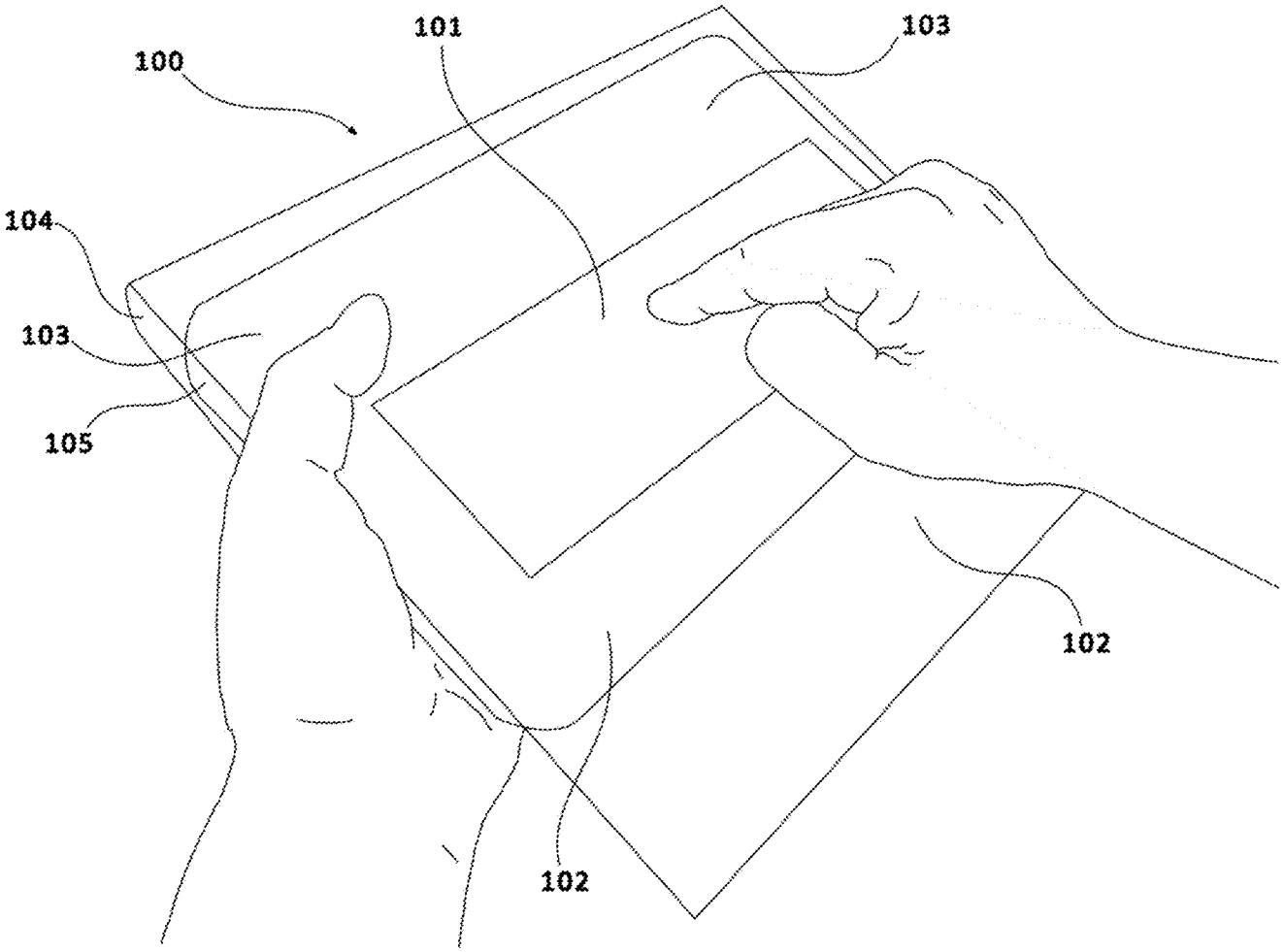
FIG. 3 is a perspective view of a user's hands placement and using index finger on the touch screen computer tablet, according to various embodiments of the present technology.
Figure 4:
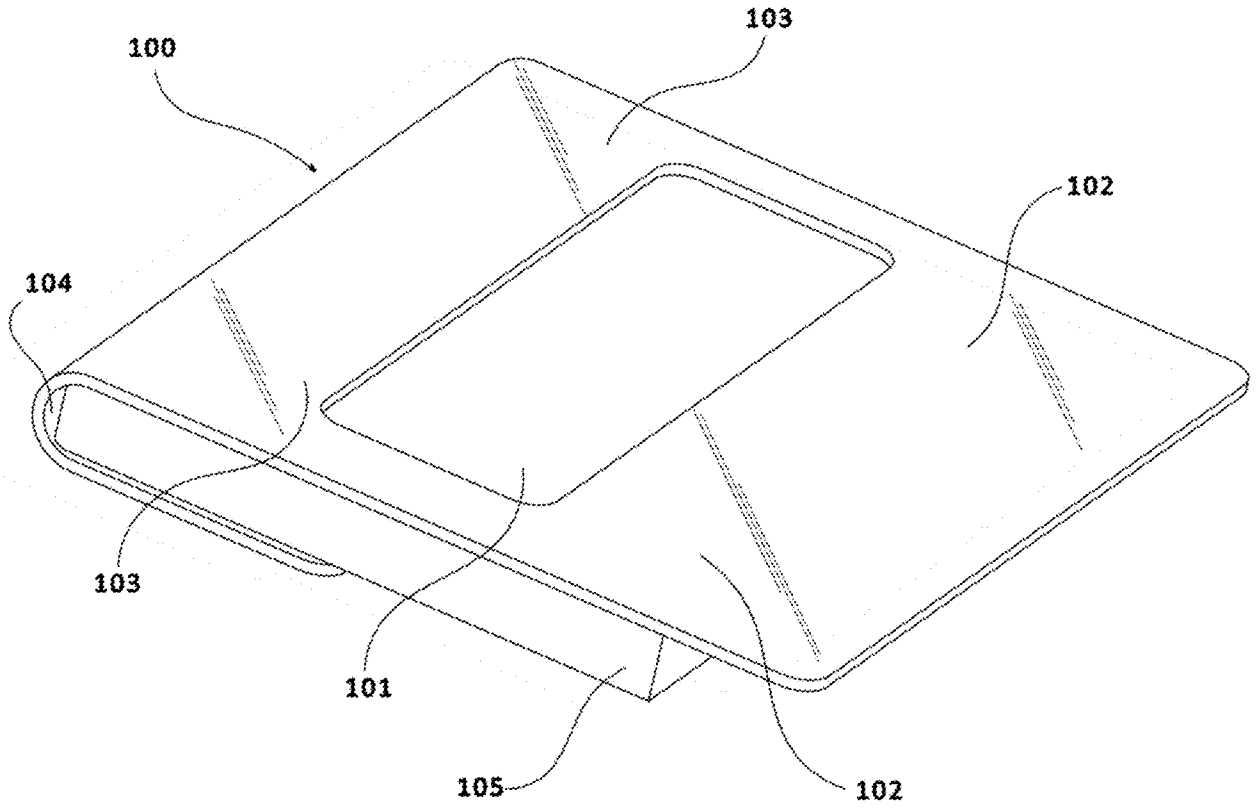
FIG. 4 is a schematic perspective view of the device, according to various embodiments of the present technology.
Figure 5:
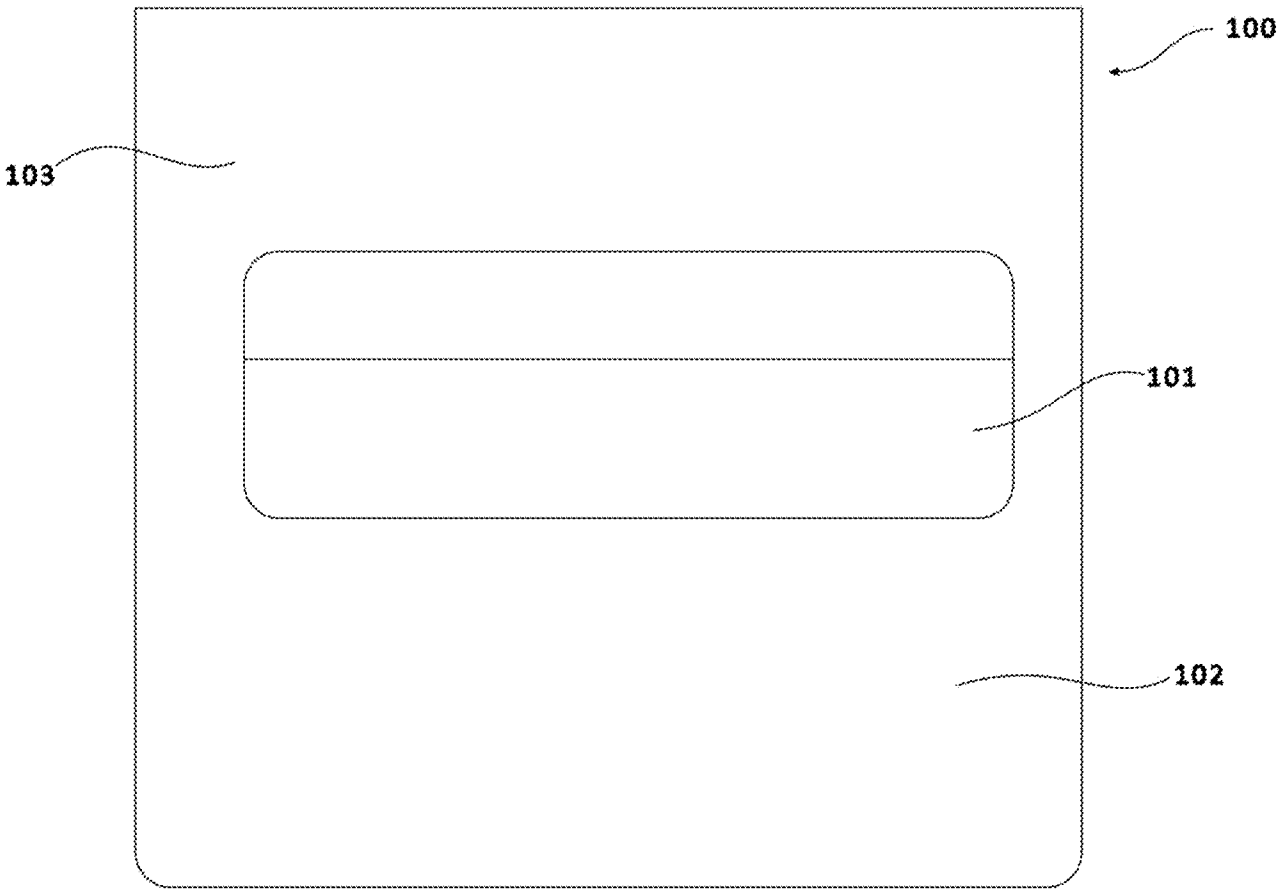
FIG. 5 is a front plan view of the device, according to various embodiments of the present technology.
Figure 6:
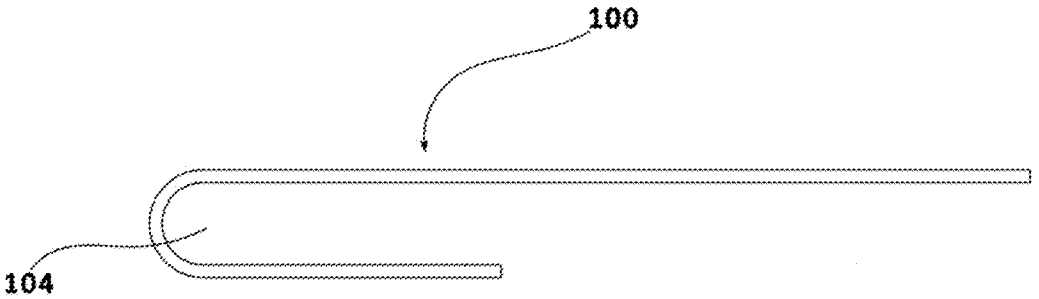
FIG. 6 is a right plan view of the device, according to various embodiments of the present technology.
Figure 7:
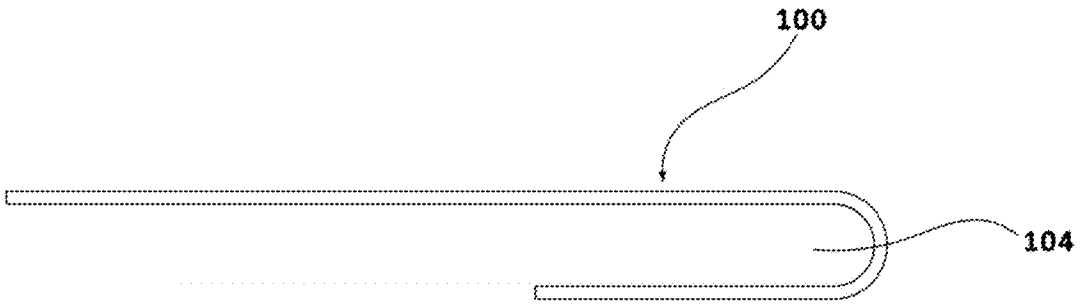
FIG. 7 is a left plan view of the device, according to various embodiments of the present technology.
Figure 8:
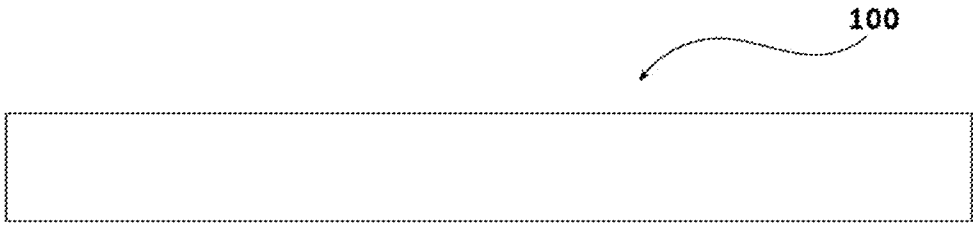
FIG. 8 is a top plan view of the device, according to various embodiments of the present technology.
Figure 9:
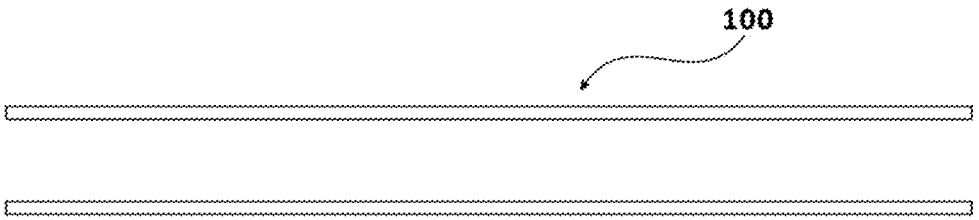
FIG. 9 is a bottom plan view of the device, according to various embodiments of the present technology.
Figure 10:
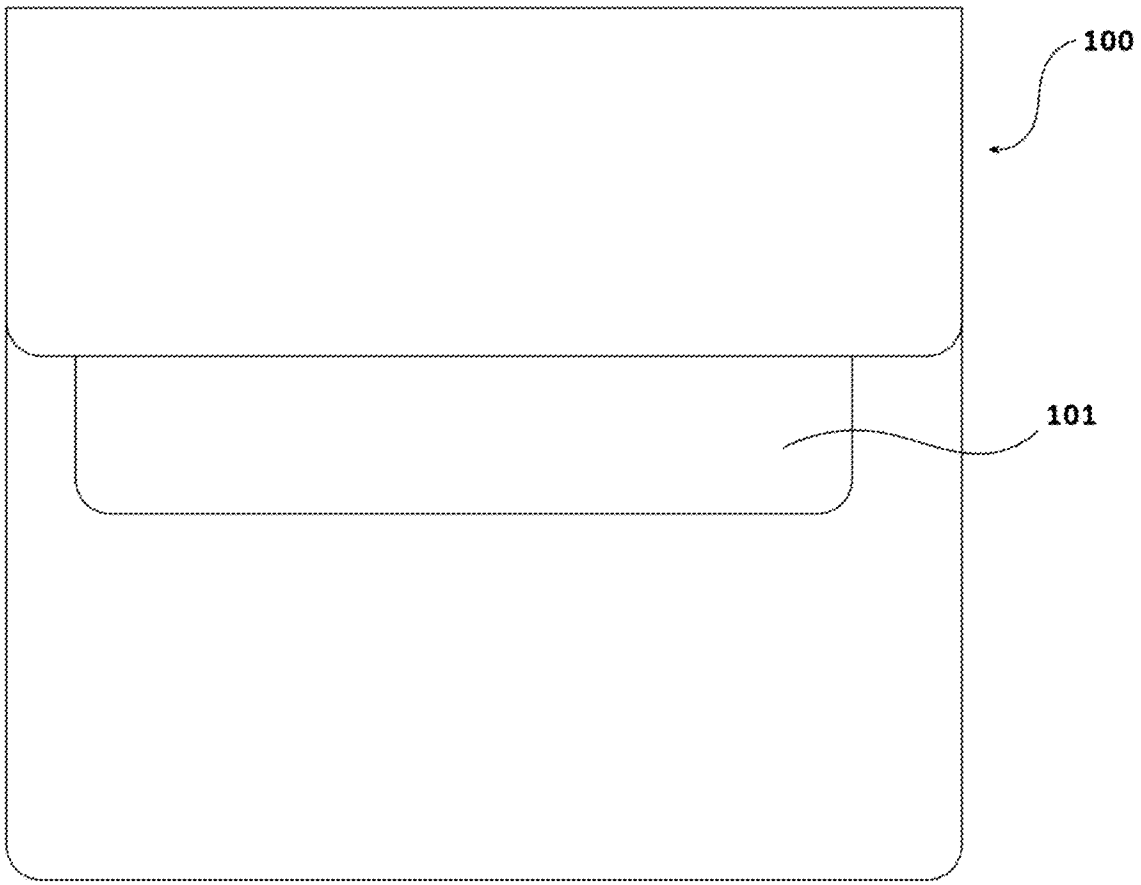
FIG. 10 is a rear plan view of the device, according to various embodiments of the present technology.
Figure 11:
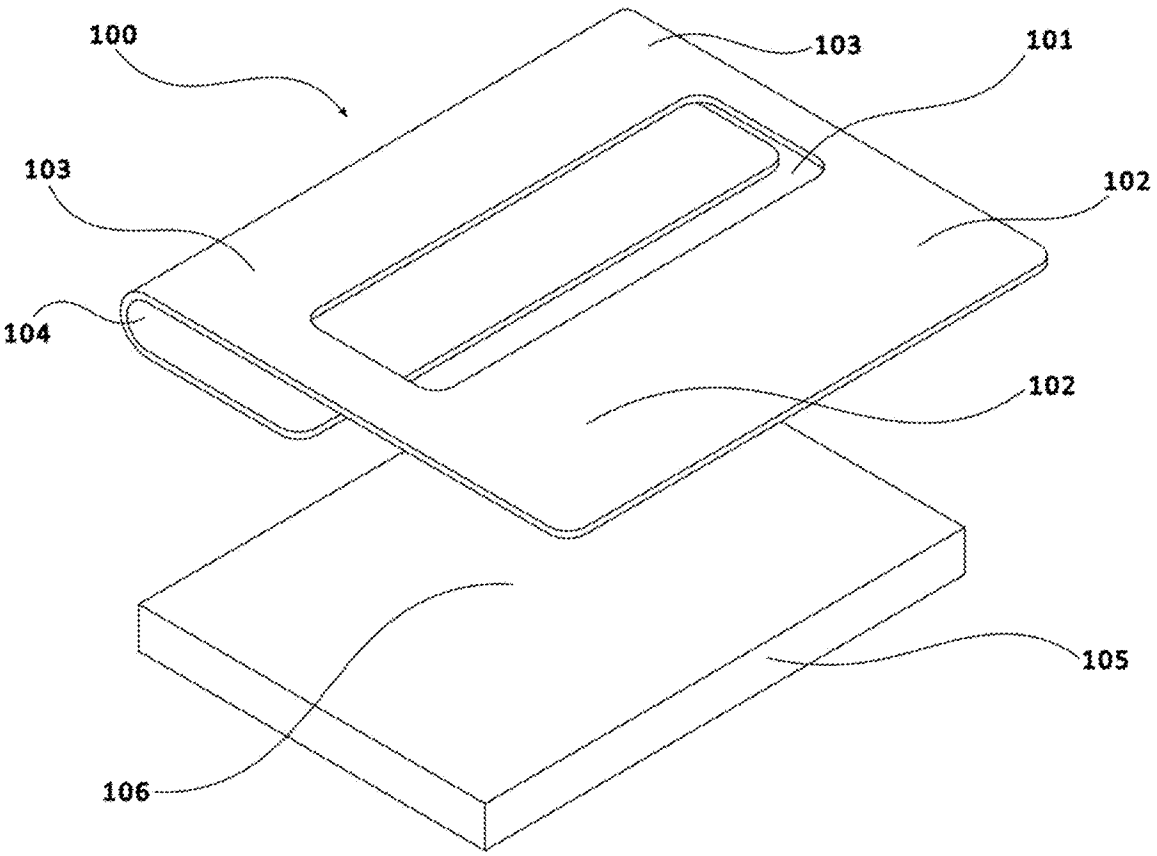
FIG. 11 is an exploded perspective view of the device, according to various embodiments of the present technology.

In some embodiments the ergonomic device 100 is made of transparent material to ensure visibility of a display of the touchscreen computer tablet 105. The anti-touch sensitivity prevents unintended activation of the touchscreen 106 of the touchscreen computer tablet 105 when the user holds the touchscreen computer tablet 105 or rests their hand on it as is illustrated in FIG. 3. This feature allows multiple users to operate the ergonomic device 100 while maintaining hygiene, as it can be easily disinfected.

Some embodiments of the present technology include software that deactivates certain portions of the touchscreen when a person is holding or resting their hand on the ergonomic device 100.

Figure 2:
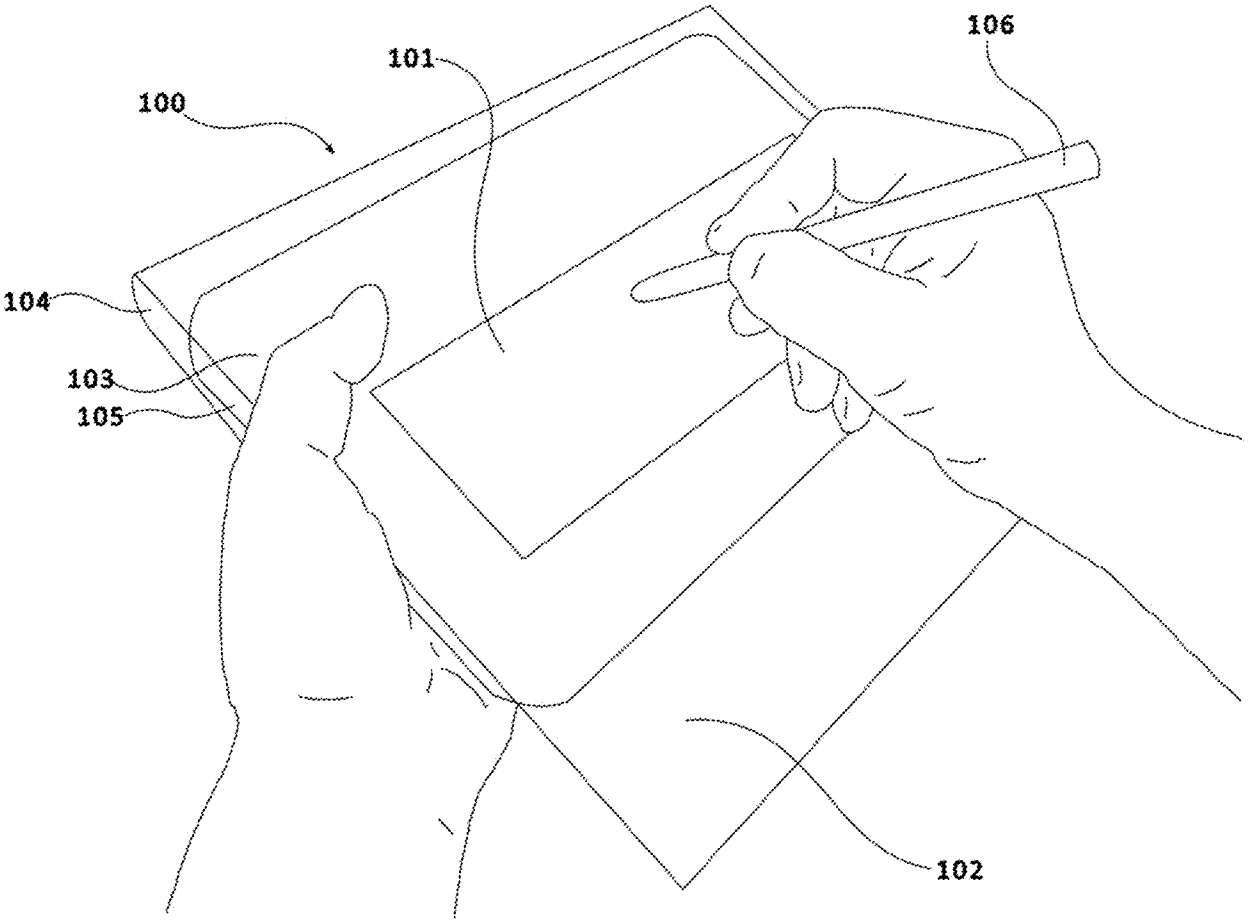
FIG. 2 is a perspective view of a user's hands placement and manipulation stylus on the touch screen computer tablet, according to various embodiments of the present technology.

In some embodiments the ergonomic device 100 includes an opening 101 that allows access to the touchscreen 106, enabling the user to write or draw with their finger, as is illustrated in FIG. 3, or with a stylus, as is illustrated in FIG. 2. This opening 101 also facilitates scrolling in different directions.

Some embodiments of the present technology include software that selectively activates portions of the touchscreen, allowing users to draw in specific sections while blocking the rest of the screen. This ensures that users can rest their hands and hold the touchscreen computer tablet 105 without unintentionally activating the touchscreen.

In some embodiments of the present technology the bottom portion 102 of the ergonomic device 100 is extended to support the user's arm and hand while drawing or writing. This feature enhances accessibility, especially for individuals with physical deformities. In the natural writing posture, the side of the palm rests on a surface; the ergonomic device 100 provides a resting portion (e.g., the bottom portion 102) beneath the open part of the touchscreen computer tablet 105 without activating the touchscreen 106 underneath.

Some embodiments of the present technology may achieve similar functionality through software that blocks portions of the screen for hand resting, or by extending a cover of the touchscreen computer tablet 105 for additional support.

In some embodiments of the present technology the top and side portions 103 of the opening 101 block a sensitivity of the touchscreen 106, allowing the user to hold the touchscreen computer tablet 105 securely without triggering the touchscreen 106. The top and side portions 103 of the opening 101 may be gripping portions that stabilize the touchscreen computer tablet 105 for writing or drawing, ensuring that the user can hold it firmly without unintentional touch activation.

Some embodiments of the present technology include software that disables touch sensitivity in certain portions or a handle added to the touchscreen computer tablet 105 or its cover.

In some embodiments, a curve 104 or an enclosed portion secures the ergonomic device 100 to the tablet, holding it in place while the user writes or draws. The curve 104 is an anchoring mechanism that ensures that the touchscreen computer tablet 105 and the ergonomic device 100 remain joined as a single unit, preventing the touchscreen computer tablet 105 from detaching or falling.

Some embodiments of the present technology include magnetic anchors, elastic bands, or ties that secure the ergonomic device 100 to the touchscreen computer tablet 105.

The ergonomic device 100 is suitable for multiple users and is easy to disinfect and clean. It features a non-slip grip for secure handling, and it provides accessibility for individuals with hand contractures, tremors, or limited range of motion.

It will be apparent to those skilled in the art that the invention enables users to draw and write on a touchscreen computer tablet while providing support for resting the hand and securely holding the ergonomic device. Various features and components may be used independently or in combination without departing from the spirit and scope of the present invention. The described embodiments are specific examples of a broader invention, and alterations to the design may be made without departing from the scope of the present invention.

Thus, the technology for an ergonomic device that has the ability to mimic the natural hand-resting posture used in traditional writing while interacting with touchscreen computer tablets is disclosed. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A device to assist a user to draw or write on a touchscreen of a tablet computer, the device comprising:

a transparent plate positioned parallel to a display surface of the touchscreen of the tablet computer;

an anchoring mechanism configured to secure the transparent plate in place relative to the tablet computer, such that the transparent plate is maintained in a fixed parallel position over the display surface of the tablet computer;

wherein the anchoring mechanism is a curved portion to anchor and stabilize the tablet computer and the transparent plate together;

wherein the curved portion is a U shape to accommodate and securely attach to the tablet computer;

one or more openings in the transparent plate, the one or more openings in the transparent plate allowing access to the display surface of the touchscreen of the tablet computer and the one or more openings in the transparent plate enabling the user to write or draw on the display surface of the touchscreen of the tablet computer;

wherein the one or more openings in the transparent plate are configured to allow scrolling in multiple directions on the display surface of the touchscreen of the tablet computer;

a bottom portion of the transparent plate configured to provide a support surface for the user's hand and wrist to rest upon while interacting with the tablet computer; and a top portion and side portions of the transparent plate surrounding at least one of the one or more openings, the top portion and the side portions of the transparent plate configured to allow the user to securely hold the tablet computer without directly touching the display surface of the tablet computer.

2. The device of claim 1, wherein the transparent plate is made of a material that is easy to clean and disinfect.

3. The device of claim 1, wherein edges of the transparent plate are smooth to prevent skin tears during use.

4. The device of claim 1, further comprising a third portion configured to securely hold a stylus, allowing easy access and storage when not in use.

5. The device of claim 1, wherein the transparent plate is made of a non-slip material, providing a secure grip to prevent the device from sliding out of the user's hands during use.

6. The device of claim 1, wherein a configuration of the transparent plate assists the user in not altering their natural writing technique when using a writing instrument.

7. The device of claim 1, wherein the transparent plate is configured to allow clear visibility of the display surface of the tablet computer, enabling the user to interact with the tablet computer without obstruction.

* * * * *